US012680404B2

(12) United States Patent
Simmonds et al.

(10) Patent No.: US 12,680,404 B2
(45) Date of Patent: Jul. 14, 2026

(54) DRAG BLOCK ASSEMBLY WITH NO EXTERNAL FASTENERS

(71) Applicant: Halliburton Energy Services, Inc., Houston, TX (US)

(72) Inventors: Tim Simmonds, Singapore (SG); Peter Reid Maher, Singapore (SG); Boon Yen Er, Singapore (SG); Garry Martin Howitt, Aberdeen (GB); Gabriel Yun Chong Chang, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/984,746

(22) Filed: Dec. 17, 2024

(65) Prior Publication Data

US 2026/0168342 A1 Jun. 18, 2026

(51) Int. Cl.
*E21B 23/01* (2006.01)

(52) U.S. Cl.
CPC ..... *E21B 23/01* (2013.01)

(58) Field of Classification Search
CPC .... E21B 23/01; E21B 31/20; E21B 33/12955; E21B 33/1291
See application file for complete search history.

(56) References Cited

U.S. PATENT DOCUMENTS 2,970,650 A * 2/1961 Baker ..... E21B 23/006 166/134
4,567,944 A * 2/1986 Zunkel ..... E21B 33/12955 166/120
4,590,995 A * 5/1986 Evans ..... E21B 33/1294 166/138
5,350,013 A 9/1994 Jani et al.
6,073,693 A 6/2000 Aldridge
9,157,289 B1 10/2015 Bair et al.
2005/0139361 A1* 6/2005 Aldridge ..... E21B 23/01 166/217
2017/0183921 A1* 6/2017 Dockweiler ..... E21B 17/1078

FOREIGN PATENT DOCUMENTS

WO 2014179008 11/2014

OTHER PUBLICATIONS

"PCT Application No. PCT/US2025/010347 International Search Report and Written Opinion", Sep. 11, 2025, 10 pages.

* cited by examiner

*Primary Examiner* — Cathleen R Hutchins
(74) *Attorney, Agent, or Firm* — DeLizio, Peacock, Lewin & Guerra LLP

(57) ABSTRACT

Embodiments of a downhole fastening method and apparatus are disclosed herein. In one embodiment, apparatus for use in a downhole environment comprises a sleeve, the sleeve including a plurality of longitudinal receiving slots in an external surface thereof; a plurality of drag blocks positioned within the longitudinal receiving slots, each drag block including an activation element for biasing the drag block radially outward and gripping elements for engaging a wellbore casing; and a retention element positioned at an uphole end of the sleeve and configured to maintain the plurality of drag blocks engaged in the plurality of longitudinal receiving slots.

19 Claims, 5 Drawing Sheets

DRAG BLOCK ASSEMBLY WITH NO EXTERNAL FASTENERS

FIELD

This disclosure relates to embodiments of a drag block assembly secured without external fasteners, the drag block assembly for use with downhole tools in a wellbore in limited space environments.

BACKGROUND

In the completion and the production of hydrocarbon wells, it is frequently necessary to isolate a portion of the well using a well tool, such as a packer, plug, tubing hanger and the like, supported in the wellbore at a subterranean location. These tools are lowered into the well in a retracted state called the "run in position;" and in a process called "setting" the tool is manipulated by mechanical movement of pipe and friction against the casing by a slipping and/or packing element are radially expanded to a "set position" wherein the slipping or packing element engage the wellbore. A variety of types of gripping elements are well known in the art. Typically, packing elements have resilient annular members mounted on the tool to move axially to pack off or seal the annulus around the tool. Such packing elements may comprise one or more resilient annular packing elements which, depending on the use environment, may also comprise back up and/or anti-extrusion rings. When these packing elements are axially compressed, they expand radially from the mandrel into contact with the wellbore. To hold these tools in place in the wellbore against movement, slipping elements may be mounted on the tool. These slipping elements or slip assemblies also expand radially to grip the wellbore when forced to compress axially and enable manipulation of and setting of the tool at any desired location in the wellbore.

Axially directed forces are used to axially compress the packing elements and slip assemblies. Such forces are typically generated by moving or manipulating the tubing string, initiating an explosive charge, or applying pressure to the tool. Examples of tools that are set by manipulating the tubing string include weight down and tension packers. A weight down packer is one in which force generated by the weight of the tubing string above the tool is used to set (expand) the packing and slip element and to hold the tool in set condition. In a tension packer, the tubing string is placed in tension and that tension force is used to set and hold the tool in the set condition.

Weight down and tension packers typically comprise a hollow tubular mandrel which is connected to the tubing string. Mounted on the mandrel are the axially compressible packing elements adjacent to the slip assembly. An annular tool element called a "drag block assembly" is located on the mandrel, adjacent the slip assembly on the opposite side from the packing elements. In weight down tools, the drag block is located below the slip means. In a tension packer, the drag block is located above the slip means. Drag block assemblies typically frictionally engage the wellbore and may be used to center the tool in the middle of the casing and to provide a resistant force or frictional force, which aids in the rotating, setting and unsetting of downhole tools. This frictional force is also referred to as "drag friction."

BRIEF DESCRIPTION OF THE DRAWINGS

Embodiments of the disclosure may be better understood by referencing the accompanying drawings.

DESCRIPTION

Figure 1:
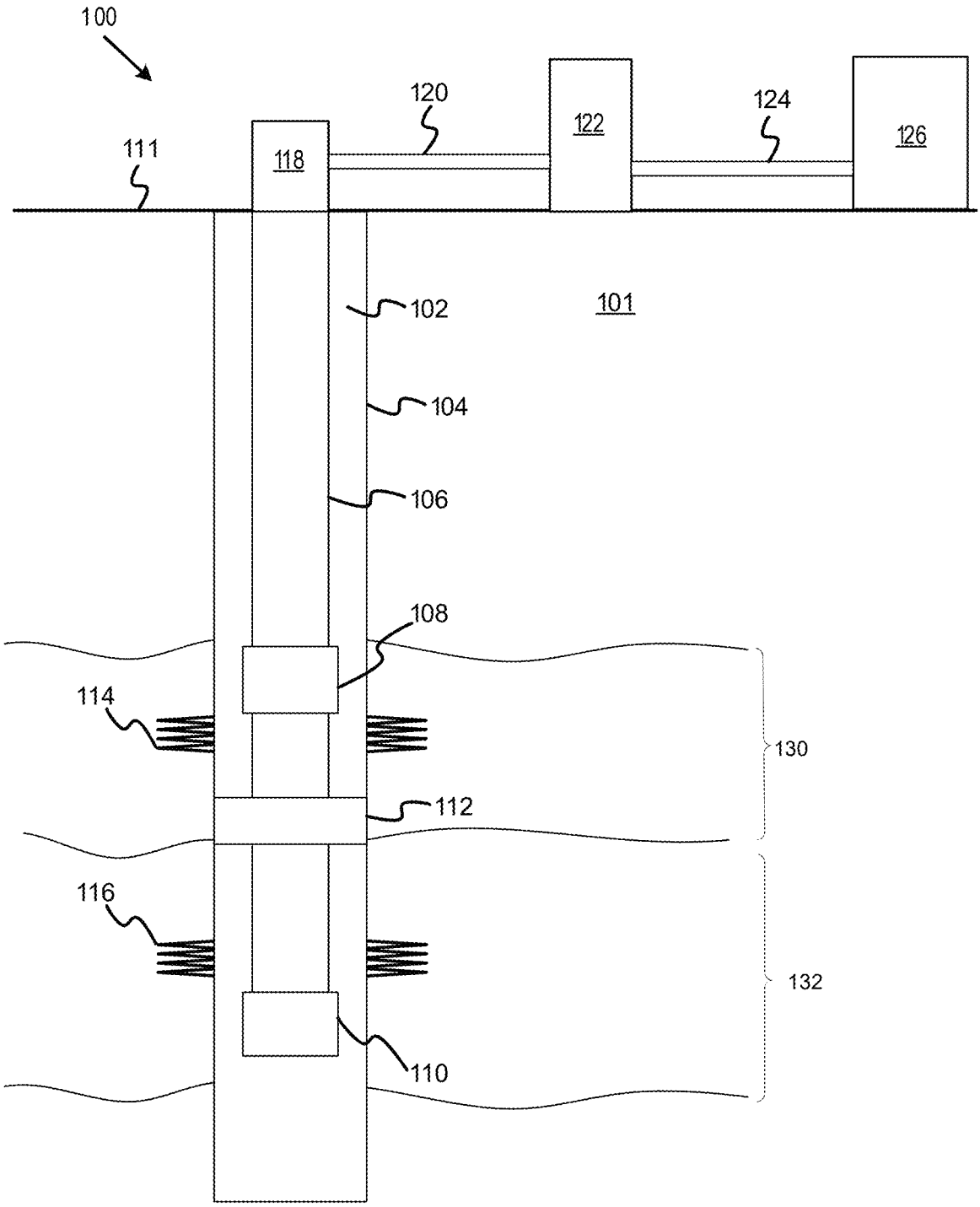
FIG. 1 is a schematic view of a well system, according to some embodiments.

The description that follows includes example systems, methods, techniques, and program flows that embody aspects of the disclosure. However, it is understood that this disclosure may be practiced without these specific details. In some instances, well-known instruction instances, protocols, structures, and techniques have not been shown in detail in order not to obfuscate the description.

Referring now to the drawings, wherein like reference numbers are used herein to designate like elements throughout the various views, various embodiments are illustrated and described. The figures are not necessarily drawn to scale; and in some instances, the drawings have been exaggerated and/or simplified in places for illustrative purposes only. In the following description, the terms "upper," "upward," "lower," "below," "downhole" and the like, as used herein, shall mean: in relation to the bottom or furthest extent of the surrounding wellbore even though the well or portions of it may be deviated or horizontal. The terms "inwardly" and "outwardly" are directions toward and away from, respectively, the geometric center of a referenced object. Where components of relatively well-known designs are employed, their structure and operation will not be described in detail. One of ordinary skill in the art will appreciate the many possible applications and variations of the present disclosure based on the following description.

Hydrocarbons, such as oil and gas, are commonly obtained from subterranean formations that may be located onshore or offshore. The development of subterranean operations and the processes involved in removing hydrocarbons from a subterranean formation may be complex. Typically, subterranean operations in a wellbore involve a number of different steps such as, for example, drilling a wellbore, at a desired well site, treating the wellbore to optimize production of hydrocarbons, and performing the necessary steps to produce and process the hydrocarbons from the subterranean formation.

Drilling a wellbore may include introducing a number of tools into the formation that may be subject to heat, shock, and vibration. Some downhole tools may require mounting of other components on to itself, requiring threads machined onto a mounting body of the tool for receiving external fasteners such as screws, bolts, threaded retainer rings, lock rings, or nuts. However, due to shock and vibration experienced by the downhole tool, the fasteners are likely to loosen, and in a worst case scenario, the secured components may become dislodged out of the main tool body in the wellbore and require a fishing or extra retrieval operation to recover the dislodged components out of the wellbore. Previous attempts to provide secondary or additional locking or security with external fasteners have failed, including adding secondary locking methods such as pin cotters, tab washers, and adhesive. Designs to remove external fasteners, typically involve adding additional length to components, particularly if using threads. These changes may not be compatible with tool operation, require adding to the tool length, and therefore substantial changes to product designs, often make updating existing assets costly and not feasible. Disclosed herein are embodiments of an apparatus, method, and system to address at least the foregoing challenges.

Disclosed herein is an apparatus, system and method for securing components, such as drag blocks, onto a downhole equipment without using external fasteners or any secondary securing method, and within limited space constraints. Examples of limited space constraints include environments having a working envelope (difference between the outer diameter and the inner diameter) is less than 1 inch, and in some embodiments may be less than 2 inches, such as assemblies having and outer diameter less than 8 inches and in some examples an inner diameter of less than 6 inches. Limited space may also refer to constraints on the lengths of the tool or components of the tools as discussed below. The proposed securing method and apparatus does not require any significant addition of length to the tool or components of the tool, which typically comes from a need to add connections/threads. In one embodiment the main securing method will not bear the primary loads of the secure components. The main securing method will also be capable of withstanding vibration, impact loads, and maintains the load path of the secured components through the main structural components of the assembly.

In traditional configurations with external fasteners, the fastening solution would see the primary load of the secured components. Thus, these primary loads would be detrimental to the fastening method causing the threaded components to slowly loosen. To overcome the fastener from loosening, a bigger sized thread has been used so that a higher tighten torque could be implemented. However, this presents a problem due to limited space constraints in downhole environments, such as limited space for the length of the tools as well as length of components of the tools, as well as the conditions experienced in the downhole environment. In the solution disclosed herein, the main fastening or securing method is anti-shock and anti-vibration, and the main component loads are not seen or encountered by the securing method. In addition, the apparatus and method disclosed herein does not require significant lengthening of components to accommodate connectors or threads for threaded retainers, such as those used in other retention methods of drag blocks that are free of external fasteners.

Solutions provided by the embodiments disclosed herein provide several following advantages, including use of a low cost commercially available retaining ring, the fastening solution does not significantly impact retention strength and load support, and is impact and vibration resistant; and the apparatus requires a relatively small space envelope to implement when compared to embodiments using external fasteners, which makes the method and apparatus disclosed herein compatible for updating existing assets, while also shortening the length and reducing costs for new products.

In one embodiment, an apparatus for use in a downhole assembly comprises at least a sleeve, the sleeve including a plurality of longitudinal receiving slots in an external surface of the sleeve. A plurality of drag blocks may be positioned within the longitudinal receiving slots, and each drag block includes an activation element for biasing the drag block radially outward. A retention element positioned at an uphole end of the sleeve is configured to maintain and secure the plurality of drag blocks engaged in the plurality of longitudinal receiving slots without the use of any external fasteners. In some embodiments, the retention element includes a split ring positioned in a first groove in the uphole end of the sleeve. The retention element may further include a retaining ring that engages the split ring and an uphole end of each drag block, and a retainer for retaining the retaining ring, the retainer positioned into a second groove at the uphole end of the sleeve. The split ring is configured to bear a primary load encountered by the drag blocks.

In another embodiment, there is disclosed a downhole system. The system includes at least a downhole tool and an apparatus coupled with the downhole tool. The apparatus may include a sleeve having a plurality of longitudinal receiving slots in an external surface of the sleeve. A plurality of drag blocks may be positioned within the longitudinal receiving slots, with each drag block including an activation element for biasing the drag block radially outward. A retention element is used to secure or fasten the plurality of drag blocks engaged in the plurality of longitudinal receiving slots.

In another embodiment, a method for fastening a component in a downhole system includes positioning a plurality of drag blocks onto a sleeve, wherein the sleeve comprises a plurality of longitudinal receiving slots in an external surface thereof, and wherein each drag block includes an activation element for biasing the drag block radially outward. The method continues with sliding each of the plurality of drag blocks into an uphole end of the receiving slots; and then securing the drag blocks in position. positioning a retention element positioned at an uphole end of the sleeve to maintain the plurality of drag blocks engaged in the plurality of longitudinal receiving slots.

EXAMPLE EMBODIMENTS

FIG. 1 is a diagrammatic illustration of an example well system, according to some implementations. In particular, FIG. 1 is a schematic of a well system 100 that includes a wellbore 102 in a subsurface formation 101. The wellbore 102 includes casing 104 and number of perforations 114, 116 being made in the casing 104. Each set of perforations 114, 116 is located in a respective reservoir 130, 132 to allow reservoir fluids (i.e., oil, water, and gas) from the respective reservoirs 130, 132 to flow into the wellbore 102 and into the tubular string 106 (the production tubing). The tubular string 106 includes at least a packer 112 that may prevent the comingling of fluids produced from the reservoirs 130, 132 in the wellbore 102. A production assembly 108 may allow the inflow of fluid produced from the reservoir 130 into the tubular string 106. Likewise, a production assembly 110 may allow the inflow of fluid produced from the reservoir 132 into the tubular string 106. Although not shown, the well system may also include one or more plugs positioned in the wellbore 102.

In some embodiments, the production assemblies 108, 110 may include one or more components requiring electric, rather than hydraulic, power. The one or more components may include one or more valves, such as production valves, one or more interval control valves, ports, packers, sleeves, or other components which may be used to control flow into, or out of the well system 100, as well as lock and latch systems, packers, and flappers. The well system 100 may also include an actuator for actuating the one or more components in the production assemblies 108, 110. The actuator may be used to actuate the one or more valves, sliding sleeves, packers, ports, drag block assemblies, or other components, to control flow into or out of the well system 100 as well as lock and latch systems, packers, and flappers.

A flowline 120 coupled to the wellhead 118 of wellbore 102 and a separator 122 may allow the fluid produced up the tubular string 106 to flow to the separator 122. The separator 122 may be designed to separate the phases of the fluid produced from the wellbore 102. For instance, oil, water, and gas may be separated from each other after passing through the separator 122. The aggregate of fluid produced from wellbore 102 may then flow to a tank battery, via flowline 124, that may include components such as storage tank 126, to store the produced fluid.

In some embodiments, the production assemblies 108, 110 may include one or more collapsible drag block assemblies for engaging the casing 104. The drag blocks may be positioned onto a drag block sleeve and have an element for biasing the drag block radially outward into engagement with the casing. In some embodiments, the element may be a spring, such as a leaf springs under the drag block acting as springs. The drag block assembly creates relative movement against the inner diameter of the casing. When the drag block is unlocked/collapsed, it is allowed to translate along the main downhole tool. When locked or engaged, the drag block assembly remain in its position and the leaf spring activates the drag block assembly radially outward such that mechanical slips on the drag blocks deploy to bite onto the casing.

A retention element may be used to secure and retain the drag block assembly onto the sleeve. The retention element is used instead of external fasteners. The retention element disclosed herein does not add extra length to the assembly, is compatible for use in small and limited space applications, and further, is capable of withstanding vibration, impact loads, and maintains the load path of the secured components, such as the drag block assembly, through the main structural components of the production assemblies 108, 110.

Figure 2:
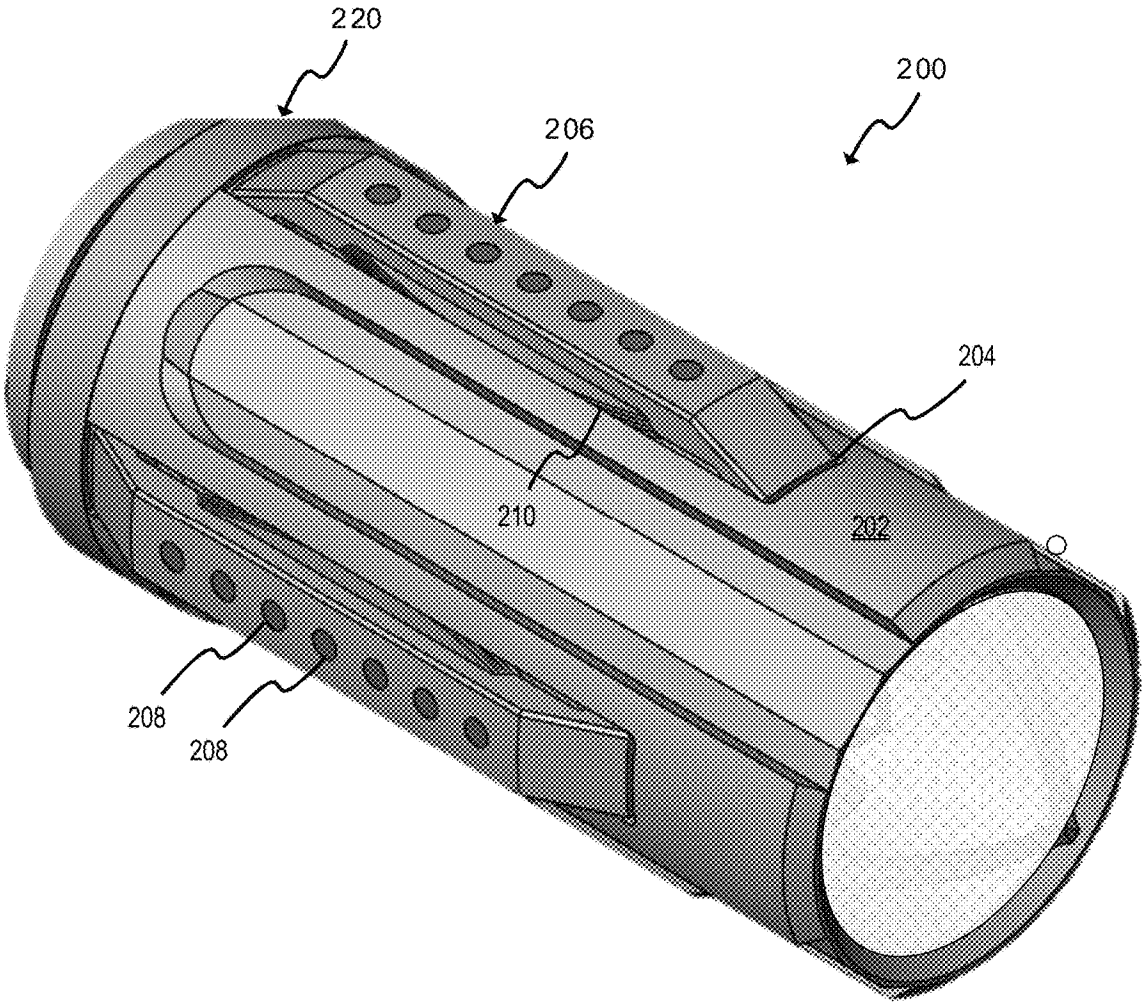
FIG. 2 is a perspective view of one embodiment of a drag block assembly, according to some embodiments.

FIG. 2 is a perspective view of one embodiment of a drag block assembly 200. The drag block assembly includes a sleeve 202. The sleeve 202 may slide over or be coupled with a mandrel of another downhole tool. The sleeve 202 includes a plurality of longitudinal receiving slots 204 for receiving drag blocks 206 therein. Each drag block may be a collapsible drag block having a plurality of mechanical slips 208 on a top side of each block 206. The mechanical slips 208 may be carbide inserts in the top of the block 206. An activating element such as leaf spring 210 is positioned beneath the drag block 206 for deploying the block radially outward beneath the block. Although the activating element in this embodiment is a leaf spring, other activating elements may be used, such as bow, coil, or compression springs and magnets, and any compressible material with recovery energy, such as elastomers in various forms and foams. The drag blocks 206 may be fastened/secured onto the sleeve 202 by a retention element 220. The retention element is shown in more detail in FIGS. 4A and 4B.

The drag block assembly 200 creates relative movement against the inner diameter of a wellbore casing, such as casing 104 in well system 100 shown in FIG. 1. When the drag blocks 206 are activated radially outward, the drag block assembly 200 remains in position and activates the mechanical slips 208 to deploy and bite onto the casing.

Figure 3A:
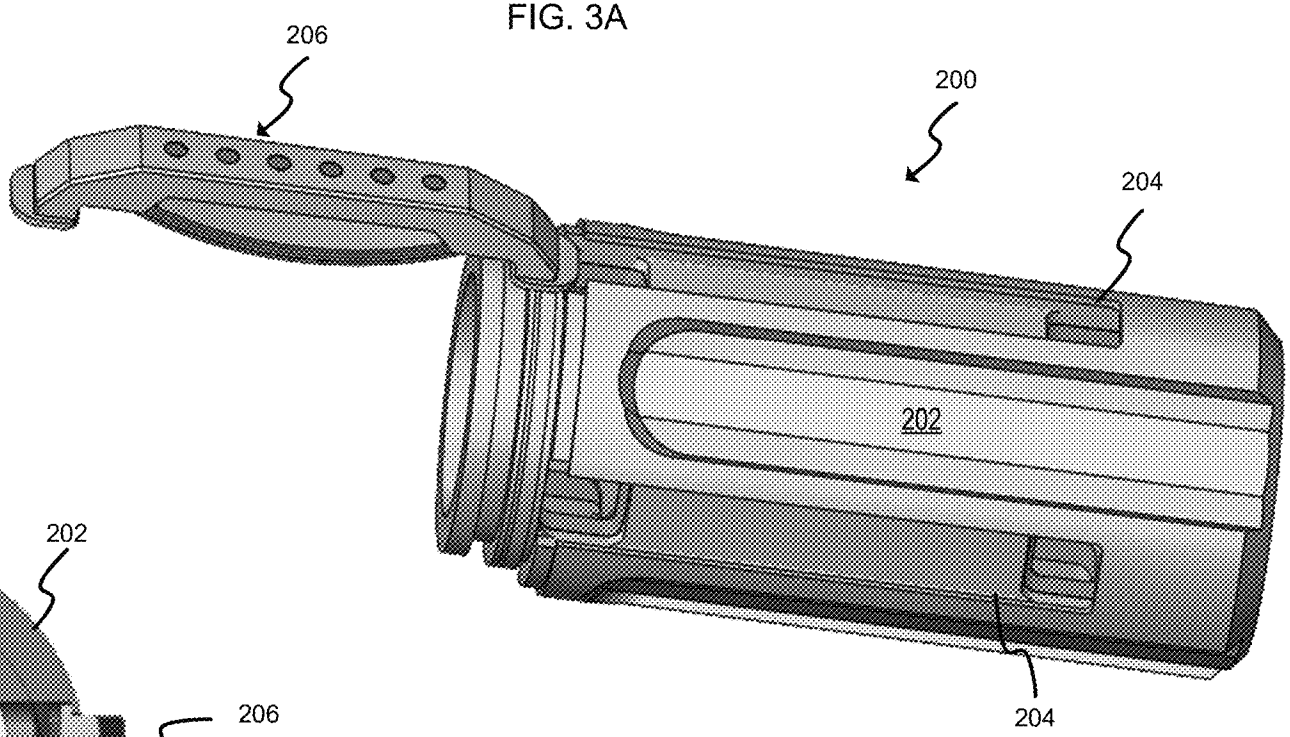
FIG. 3A is a perspective view illustrating another feature of the drag block assembly, according to some embodiments.
Figure 3C:
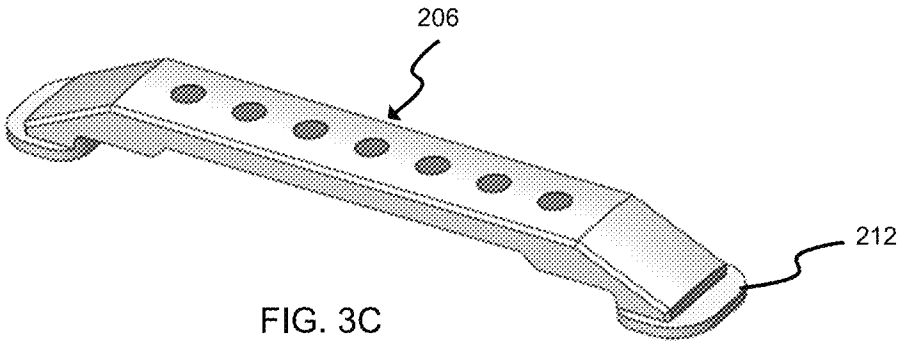
FIG. 3C is a perspective view of a drag block of the drag block assembly, according to some embodiments.
Figure 3B:
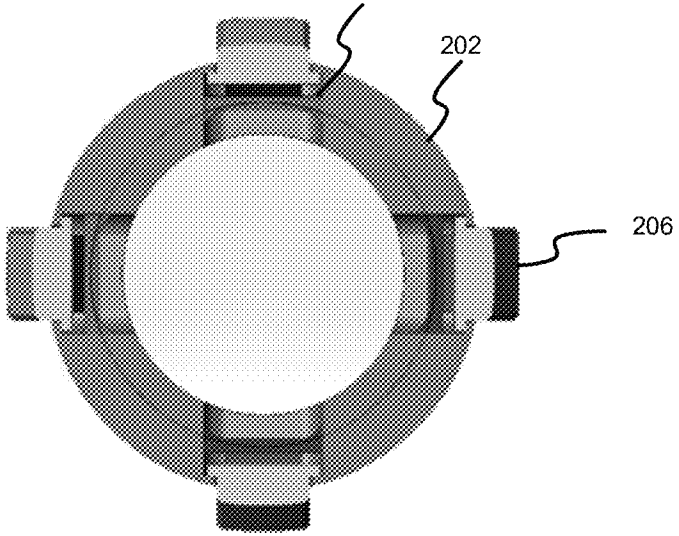
FIG. 3B is an end view of the drag block assembly, according to some embodiments.

Referring now to FIG. 3A through 3C there is shown a drag block 206 being positioned into the receiving slot 204 of the sleeve 202. The receiving slot 204, in this embodiment may comprise a female T-shaped cavity. As shown in FIG. 3C, the drag block 206 may comprise a dovetail or male T-shaped foot 212 at each end. The T-shaped foot 212 fits into the female T-shaped cavity of receiving slot 204 (as shown in FIG. 3B) to allow positive retention of the drag block 206 during extend and collapse operations. In this example, the female T-shape of the slots 204 and male T-shaped foot 212 at the ends of the drag block 206 allow only one direction to install and uninstall the drag blocks 206 from the sleeve 202.

FIG. 3B is an end view of the drag block assembly 200 showing each drag block 206 positioned into the slots 204 of the sleeve 202. Although the example shown has four drag blocks 206, other embodiments may include more or fewer drag blocks, according to the implementation. In addition to the dovetail or male T-shaped foot 212, embodiments of the drag block 206 have a shorter/lower profile than traditional drag block elements, which further enables the drag block assembly 200 disclosed herein to be used in small or limited space applications.

Figure 4A:
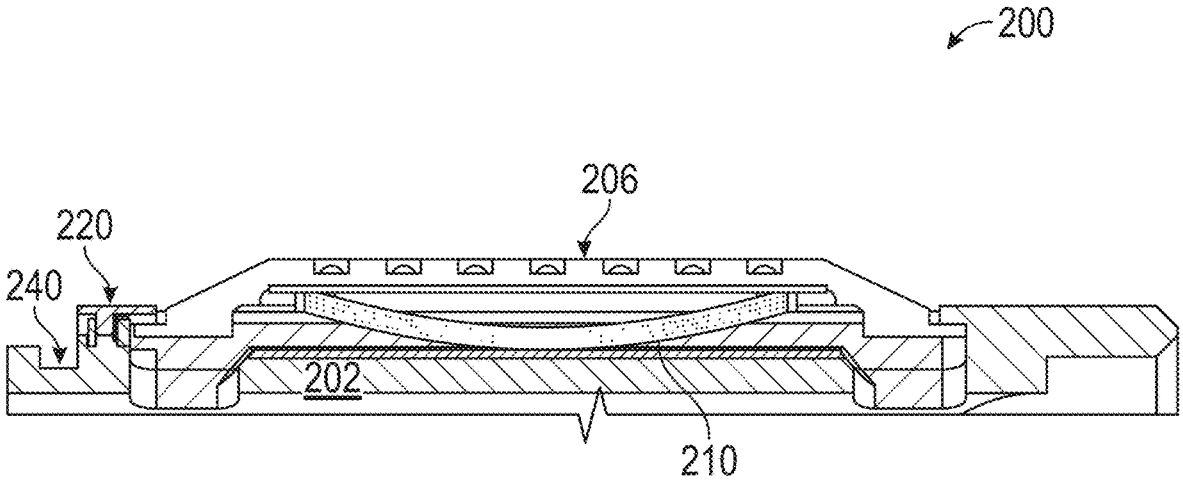
FIGS. 4A and 4B are side views of the apparatus, according to some embodiments.
Figure 4B:
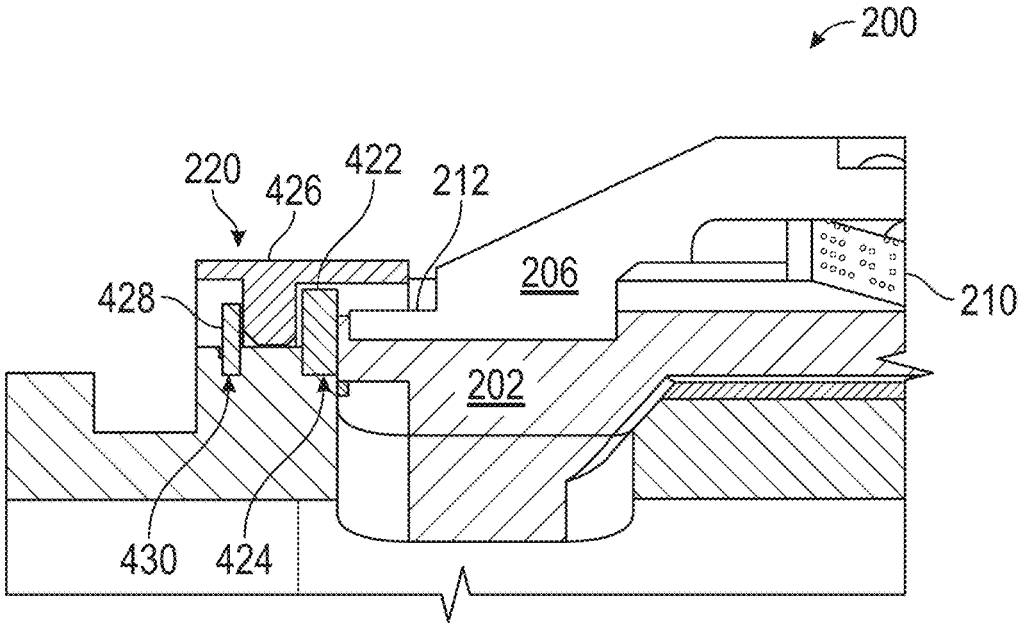

Referring now to FIGS. 4A and 4B, there is shown side views of the drag block assembly 200 and a more detailed view of the retention element 220. Once all the drag blocks 206 are installed, a split ring 422, which may be C-shaped, will be inserted into a first groove 424 at an uphole end of the sleeve 202. This ring 422, in this example is the primary load bearing ring for the drag block 206 during operation. If the drag blocks 206 move backward and contact the ring 422 during downhole movement into the casing, the forces would be imparted to the ring 422 and then to the sleeve 202 itself. The ring 422 is retained in place with a retainer 426, which may be a retainer cover over the split ring and a retaining ring. The retainer 426 is secured down with a retaining ring 428. The retaining ring 428 is positioned into a second groove 430 at an uphole end of the sleeve 202. The retaining ring 428 may only see loading from the retainer 426, which in most embodiments will be very minimum loading as the loading from the retainer 426 may be light when compared to the load from the drag blocks 206, operation shock and vibration loading.

The sleeve 202 may further include a third groove 240 for receiving an adjacent tool onto the drag block assembly. An embodiment of the retention element 220 may similarly be used to secure the adjacent tool. The adjacent tool may be a packer, plug, hanging element, or any other tool which may generally be manipulated by mechanical movement of the pipe and be used in conjunction with drag block assemblies.

Components of the drag block assembly 200 may include various materials, including, but not limited to carbon steel, stainless steel, and inconcel. Sleeve 202 may be formed from a drillable material such as brass or composite materials such as engineered plastics. Specific plastics may include nylon, phenolic materials and epoxy resins. The drag blocks 206 may also be formed from a composite material or can be molded from an elastomeric material. The mechanical slips 208 may comprise wear resistant materials, such as composite materials (hard rubber, resins and the like), metallic materials (steel, carbide and the like), and ceramic materials. The split ring 422, retainer, 426 and retaining ring 428 may be constructed using metals, polymers, and other durable materials capable of withstanding conditions in a wellbore environment.

Example Operations

Figure 5:
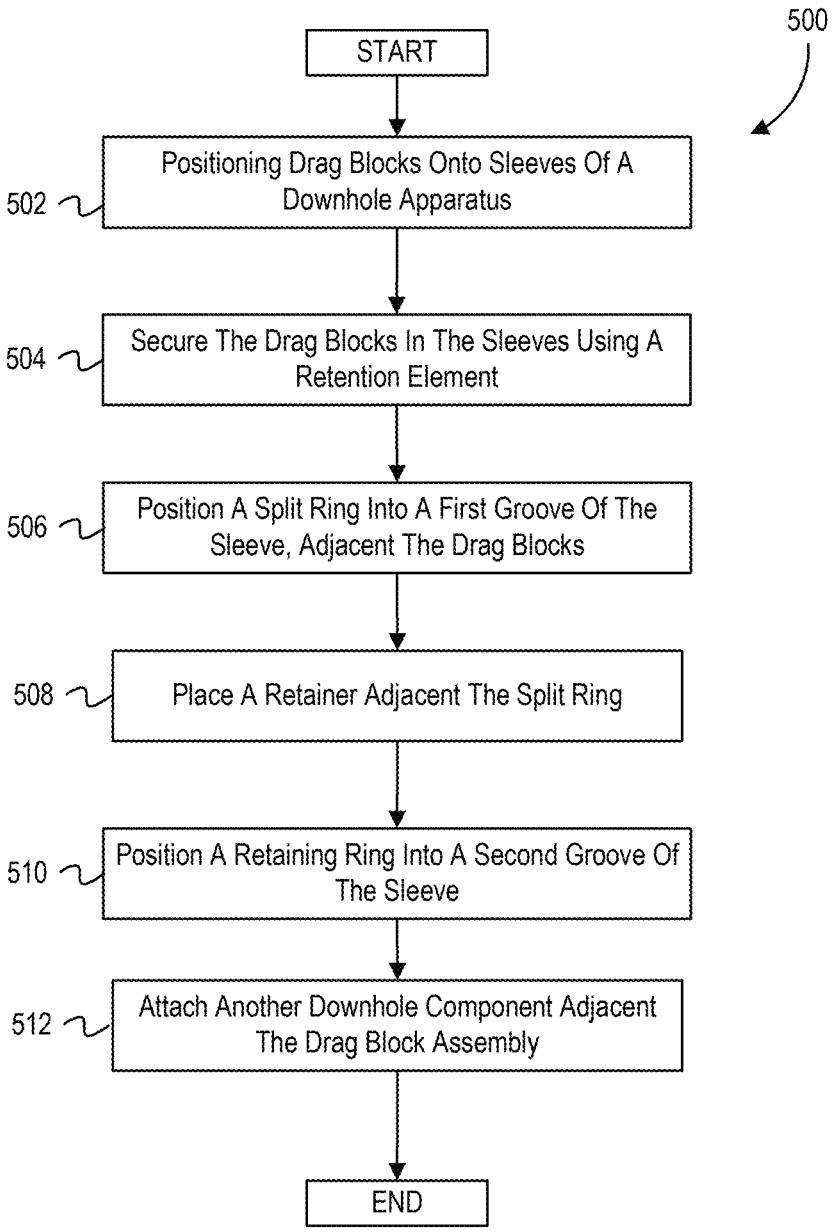
FIG. 5 is a flowchart illustrating a method, according to some embodiments.

Referring now to FIG. 5, there is shown one embodiment of a method 500 for securing features of an assembly for use in a wellbore. The method begins at a block 502 with a plurality of drag blocks positioned onto a sleeve. Each sleeve comprises a plurality of longitudinal receiving slots in an external surface thereof. Positioning the drag blocks onto the sleeves includes sliding each of the plurality of drag blocks into an uphole end of the receiving slots.

The method continues at a block 504 to fasten or secure the drag blocks in the sleeves using retention element and without any external fasteners. Fastening the drag blocks includes the operations of blocks 506-510.

At a block 506, a split ring is positioned in a first groove in the uphole end of the sleeve adjacent the uphole end of the drag blocks.

The method continues at block 508, placing a retainer that engages the split ring. The retainer in some embodiments may also overhang the uphole end of the drag blocks.

The method continues at a block 510 to position a retaining ring into a second groove at the uphole end of the sleeve for retaining the retainer in place.

In most embodiments, another downhole tool may be coupled with the drag block assembly at a block 512. In some embodiments this may be a packer, a plug, or various other downhole tools traditionally placed adjacent to or in conjunction with one or more drag block assemblies.

Plural instances may be provided for components, operations or structures described herein as a single instance. Finally, boundaries between various components, operations and data stores are somewhat arbitrary, and particular operations are illustrated in the context of specific illustrative configurations. Other allocations of functionality are envisioned and may fall within the scope of the disclosure. In general, structures and functionality presented as separate components in the example configurations may be implemented as a combined structure or component. Similarly, structures and functionality presented as a single component may be implemented as separate components. These and other variations, modifications, additions, and improvements may fall within the scope of the disclosure.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed.

EXAMPLE EMBODIMENTS

Aspects disclosed herein include:

Aspect A: An apparatus for use in a downhole environment, within a limited or small space constraint, comprising at least a sleeve, the sleeve including a plurality of longitudinal receiving slots in an external surface thereof; a plurality of drag blocks positioned within the longitudinal receiving slots, each drag block including an activation element for biasing the drag block radially outward and gripping elements for engaging a wellbore casing; and a retention element positioned at an uphole end of the sleeve and configured to maintain the plurality of drag blocks engaged in the plurality of longitudinal receiving slots.

Aspect B: A system for use in a wellbore, comprising a downhole tool; a drag block assembly coupled with the downhole tool, the drag block assembly comprising: a sleeve, the sleeve including a plurality of longitudinal receiving slots in an external surface thereof; a plurality of drag blocks positioned within the longitudinal receiving slots, each drag block including an activation element for biasing the drag block radially outward; and a retention element positioned at an uphole end of the sleeve and configured to maintain the plurality of drag blocks engaged in the plurality of longitudinal receiving slots.

Aspect C: A method for fastening a component in a downhole system, comprising: positioning a plurality of drag blocks onto a sleeve, wherein the sleeve comprises a plurality of longitudinal receiving slots in an external surface thereof, and wherein each drag block includes an activation element for biasing the drag block radially outward; sliding each of the plurality of drag blocks into an uphole end of the receiving slots; and securing the drag blocks with a retention element and without any external fasteners.

Aspects A, B, and C may have one or more of the following additional elements in combination:

Element 1: wherein the drag blocks have a male T-shaped foot at each end.

Element 2: wherein the receiving slots have a female T-shape configured to receive the male T-shaped foot of the drag block.

Element 3: wherein the retention element includes a split ring positioned in a first groove in the uphole end of the sleeve.

Element 4: wherein the retention element further includes a retaining ring that engages the split ring and each drag block.

Element 5: wherein the retention element further includes a retainer for retaining the retaining ring, the retainer positioned into a second groove at the uphole end of the sleeve.

Element 6: wherein the split ring is configured to bear a primary load encountered by the plurality of drag blocks.

Element 7: wherein the activation element is a spring.

Element 8: wherein the sleeve further includes a third groove in an uphole end for receiving and fastening another downhole component with the drag block assembly.

Element 9: wherein the retention element includes a split ring positioned in a first groove in the uphole end of the sleeve, and wherein the retention element further includes a retaining ring that engages the split ring and each drag block.

Element 10: wherein the retention element includes a split ring, a retaining ring, and a retainer, and wherein securing the drag blocks with the retention element includes: positioning the split ring into a first groove in an uphole end of the sleeve; placing the retaining ring adjacent to the split ring; and positioning the retainer into a second groove in the uphole end of the sleeve and adjacent the retaining ring.

Element 11: wherein the split ring is configured to bear a primary load encountered by the drag blocks.

Element 12: further comprising coupling a downhole tool with the sleeve, wherein the downhole tool engages into a third groove in the uphole end of the sleeve.

The invention claimed is:

1. An apparatus for use in a downhole environment, comprising:

a sleeve, the sleeve including a plurality of longitudinal receiving slots in an external surface thereof, wherein the longitudinal receiving slots extend from an uphole end of the sleeve;

a plurality of drag blocks positioned within the longitudinal receiving slots, each drag block including an activation element for biasing the drag block radially outward and gripping elements for engaging a wellbore casing; and a retention element positioned at the uphole end of the sleeve, the retention element including a split ring positioned in a first groove of the sleeve proximate to an uphole end of each of the longitudinal receiving slots, the retention element configured to retain each drag block in a respective one of the plurality of longitudinal receiving slots.

2. The apparatus according to claim 1, wherein the drag blocks have a male T-shaped foot at each end.

3. The apparatus according to claim 2, wherein the longitudinal receiving slots have a female T-shape configured to receive the male T-shaped foot of the drag block.

4. The apparatus according to claim 1, wherein the retention element further includes a retainer and a retaining ring, wherein the retaining ring secures the retainer to the split ring.

5. The apparatus according to claim 1, wherein the retention element further includes a retainer and a retaining ring, the retainer holding the split ring in place, the retaining ring positioned into a second groove at the uphole end of the sleeve to secure the retainer.

6. The apparatus according to claim 5, wherein the split ring is configured to bear a primary load encountered by the plurality of drag blocks.

7. The apparatus according to claim 5, wherein the sleeve further includes a third groove in an uphole end of the sleeve, the third groove for receiving and fastening another downhole component with the apparatus.

8. The apparatus according to claim 1, wherein the activation element is a spring.

9. A system for use in a wellbore, comprising:

a downhole tool;

a drag block assembly coupled with the downhole tool, the drag block assembly comprising:

a sleeve, the sleeve including a plurality of longitudinal receiving slots in an external surface thereof, wherein the longitudinal receiving slots extend from an uphole end of the sleeve;

a plurality of drag blocks positioned within the longitudinal receiving slots, each drag block including an activation element for biasing the drag block radially outward; and a retention element positioned at an uphole end of the sleeve, the retention element including a split ring positioned in a first groove of the sleeve proximate to an uphole end of each of the longitudinal receiving slots, the retention element configured to retain each drag block in a respective one of the plurality of longitudinal receiving slots.

10. The system according to claim 9, wherein the retention element further includes a retaining ring.

11. The system according to claim 10, wherein the retention element further includes a retainer for retaining the split ring, and wherein the retaining ring is positioned into a second groove at the uphole end of the sleeve.

12. The system according to claim 11, wherein the sleeve further includes a third groove in an uphole end for receiving and fastening the downhole tool with the drag block assembly.

13. The system according to claim 10, wherein the split ring is configured to bear a primary load encountered by the plurality of drag blocks.

14. The system according to claim 9, wherein the activation element is a spring.

15. A method for fastening a component in a downhole system, comprising:

positioning a plurality of drag blocks onto a sleeve, wherein the sleeve comprises a first groove and a plurality of longitudinal receiving slots downhole of the first groove on an external surface of the sleeve, wherein the longitudinal receiving slots extend from an uphole end of the sleeve, and wherein each drag block includes an activation element for biasing the drag block radially outward;

sliding each of the plurality of drag blocks into an uphole end of a respective one of the longitudinal receiving slots; and securing the drag blocks with a retention element, the retention element including a split ring, wherein securing includes installing the split ring into the first groove to secure the drag blocks in their respective longitudinal receiving slots.

16. The method according to claim 15, wherein the drag blocks have a male T-shaped foot at each end and the longitudinal receiving slots have a female T-shape configured to receive the male T-shaped feet of the drag blocks.

17. The method according to claim 15, wherein the retention element further includes, a retaining ring and a retainer, and wherein securing the drag blocks with the retention element includes:

placing the retaining ring in a second groove; and positioning the retainer adjacent the retaining ring and the split ring, the retainer, when positioned, holding the split ring in place.

18. The method according to claim 17, further comprising coupling a downhole tool with the sleeve, wherein the downhole tool engages into a third groove in the uphole end of the sleeve.

19. The method according to claim 15, wherein the split ring is configured to bear a primary load encountered by the drag blocks.

* * * * *